US009337589B2

(12) United States Patent
Wang et al.

(10) Patent No.: US 9,337,589 B2
(45) Date of Patent: May 10, 2016

(54) ELECTRICAL CONNECTOR WITH METAL PLATE

(71) Applicant: HON HAI PRECISION INDUSTRY CO., LTD., New Taipei (TW)

(72) Inventors: Ji-Chao Wang, Kunshan (CN); Hong-Bin Gong, Kunshan (CN); Guo-Hua Zhang, Kunshan (CN); Qi-Sheng Zheng, Kunshan (CN); Xiao-Wei Gong, Kunshan (CN)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/298,757

(22) Filed: Jun. 6, 2014

(65) Prior Publication Data

US 2014/0364007 A1 Dec. 11, 2014

(30) Foreign Application Priority Data

Jun. 6, 2013 (CN) ..... 2013 2 0323672
Jun. 6, 2013 (CN) ..... 2013 2 0323814

(51) Int. Cl.

| | |
|---|---|
| ***H01R 24/62*** | (2011.01) |
| ***H01R 13/6596*** | (2011.01) |
| ***H01R 13/6461*** | (2011.01) |
| *H01R 12/72* | (2011.01) |
| *H01R 25/00* | (2006.01) |

(52) U.S. Cl.

CPC ..... *H01R 13/6596* (2013.01); *H01R 13/6461* (2013.01); *H01R 12/724* (2013.01); *H01R 25/006* (2013.01)

(58) Field of Classification Search

CPC ..... H01R 13/6596; H01R 13/6461; H01R 12/724; H01R 13/6581
USPC ..... 439/607.27, 607.11, 607.23
See application file for complete search history.

(56) References Cited

U.S. PATENT DOCUMENTS 5,797,770 A * 8/1998 Davis ..... H01R 23/6873 439/607.27
6,155,872 A * 12/2000 Wu ..... H01R 13/514 439/541.5

(Continued)

FOREIGN PATENT DOCUMENTS

CN 102315560 A 6/2011

OTHER PUBLICATIONS

English Translation of Li (CN 102315560), Published Jan. 11, 2012, Translation Made Jun. 8, 2015.*

*Primary Examiner* — Amy Cohen Jackson
*Assistant Examiner* — Matthew T Dzierzynski
(74) *Attorney, Agent, or Firm* — Wei Te Chung; Ming Chieh Chang

(57) ABSTRACT

An electrical connector comprises an insulative housing having a base portion with a rear room depressed thereof, a top and a lower tongue portions extending forwardly, a plurality of contacts retained to the insulative housing, a spacer received in the rear room, and a metal shell having two side walls covering two sides of the insulative housing. The spacer has a base, a front portion and a rear portion extending upwardly from the base, and a groove depressed between the front and the rear portion. A metal plate received in the groove. The metal plate has a pair of cantilever arms extending downwardly from two side edges of the main portion. The pair cantilever arms are mirror and coplanar to each other, each of the cantilever arm having a protruding portion protruding beyond a side of the insulative housing to abut against the side wall of the metal shell.

20 Claims, 8 Drawing Sheets

(56) References Cited

U.S. PATENT DOCUMENTS 6,238,244 B1 * 5/2001 Yang ..... H01R 23/6873 439/541.5
6,520,799 B1 * 2/2003 Cheng ..... H01R 13/7172 439/541.5
7,481,677 B1 * 1/2009 Yi ..... H01R 13/6485 439/541.5
7,604,490 B2 * 10/2009 Chen ..... H01R 13/6471 439/541.5
7,690,947 B2 * 4/2010 Gu ..... H01R 13/41 439/607.23
7,811,110 B2 * 10/2010 He ..... H01R 13/405 439/218
7,997,927 B2 * 8/2011 Wan ..... H01R 12/724 439/541.5
8,070,512 B2 * 12/2011 Xuan ..... H01R 13/506 439/541.5
8,568,171 B2 * 10/2013 Yang ..... H01R 13/502 439/607.27
2013/0273774 A1 * 10/2013 Yang ..... 439/607.58
2014/0357124 A1 * 12/2014 Zhao et al. ..... 439/607.55

* cited by examiner

ELECTRICAL CONNECTOR WITH METAL PLATE

BACKGROUND OF THE INVENTION

1. Field of the Invention

The present invention generally relates to an electrical connector and more particularly to an electrical connector with a metal plate retained in a spacer of the electrical connector.

2. Description of Related Art

China patent No. CN102315560A, published on Jun. 1, 2011, discloses such a stacked electrical connector which includes an insulative housing defining a base portion with a receiving room depressed thereon along a rear-to-front direction, a couple of upper and lower tongue plates extending from the base portion for electrically engaging with mating connectors. First and second sets of conductive terminals are accommodated in the passageways of upper and lower tongue plates. A spacer received in the receiving room defines a groove for receiving a metal plate set between the first and second sets of conductive terminals. A shield shell encloses the insulative housing. The metal plate has a base portion and two protruding portions protruding from two side edges of the base portion to engage with the shield shell. However the protruding portion bent backwardly and just has a short length. The extending direction of the protruding portion is perpendicular to the extending direction of the base portion. So, the protruding portion may not give a quality elastic force to engage with the shield shell, if the protruding portion being given an excessive force, the protruding portion may cause a rigid deformation, that may cause the metal plate not connecting with the shield shell stably.

It is thus desired to provide an improved connector.

SUMMARY OF THE INVENTION

According to one aspect of the present invention provides an electrical connector comprising an insulative housing having a base portion with a rear room depressed thereof along an rear-to-front direction, a top and a lower tongue portions extending forwardly from the base portion, a plurality of contacts retained to the insulative housing, a spacer received in the rear room, a metal plate having a main portion retained in the spacer vertically and a metal shell having two side walls covering two sides of the insulative housing. The contacts have a plurality of upper contacts with a plurality of contact portions disclosed on a bottom side of the top tongue portion and a plurality of lower contacts with a plurality of contact portions disclosed on a bottom side of the lower tongue portion. The metal plate at least has a cantilever arm extending downwardly from a side end of the main portion, the cantilever arm and the main portion are coplanar with each other. Wherein the cantilever arm cantilevered extends outside of the a side of the spacer and having a protruding portion protruding beyond a side of the insulative housing to abut against the side wall of the metal shell.

According to one aspect of the present invention provides an electrical connector comprising an insulative housing having a base portion with a rear room depressed thereof along an rear-to-front direction, a top and a lower tongue portions extending forwardly from the base portion. A plurality of contacts are retained to the insulative housing, the contacts have a plurality of upper contacts with a plurality of contact portions disclosed on a bottom side of the top tongue portion and a plurality of lower contacts with a plurality of contact portions disclosed on a bottom side of the lower tongue portion. A spacer is received in the rear room. A metal shell has two side walls covering two sides of the insulative housing. Wherein a metal plate has a main portion retained in the spacer vertically, a slit extending through a side of the main portion along a front-to-rear direction to form a bridge beam, the bridge beam forms a protruding portion protruding outside of the insulative housing to engage with the side wall of the metal shell.

Other objects, advantages and novel features of the present invention will become more apparent from the following detailed description of the present embodiment when taken in conjunction with the accompanying drawings.

DETAILED DESCRIPTION OF THE INVENTION

Figure 1:
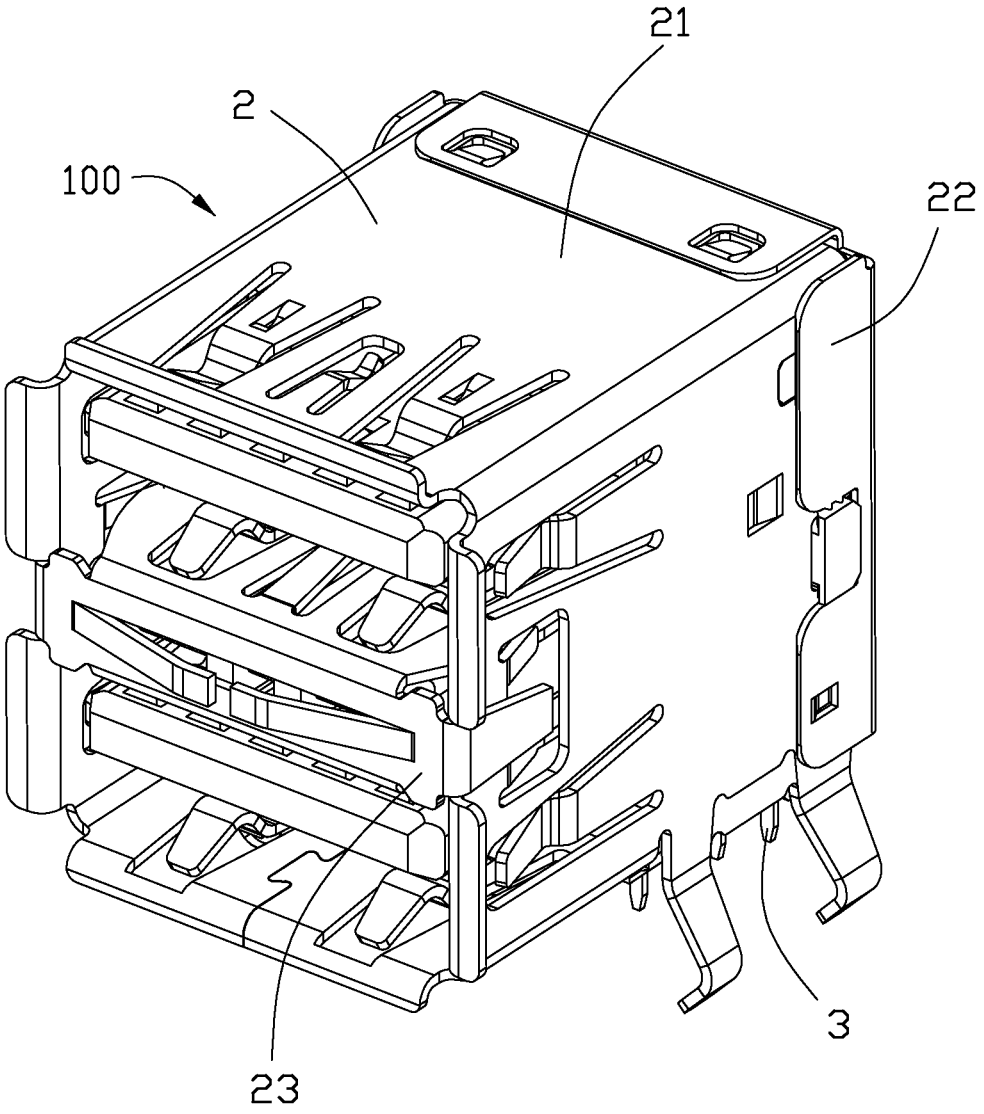
FIG. 1 is an assembled perspective view of an electrical connector according to a first embodiment of the present invention.

Reference will now be made to the drawing figures to describe the preferred embodiment of the present invention in detail.

Figure 2:
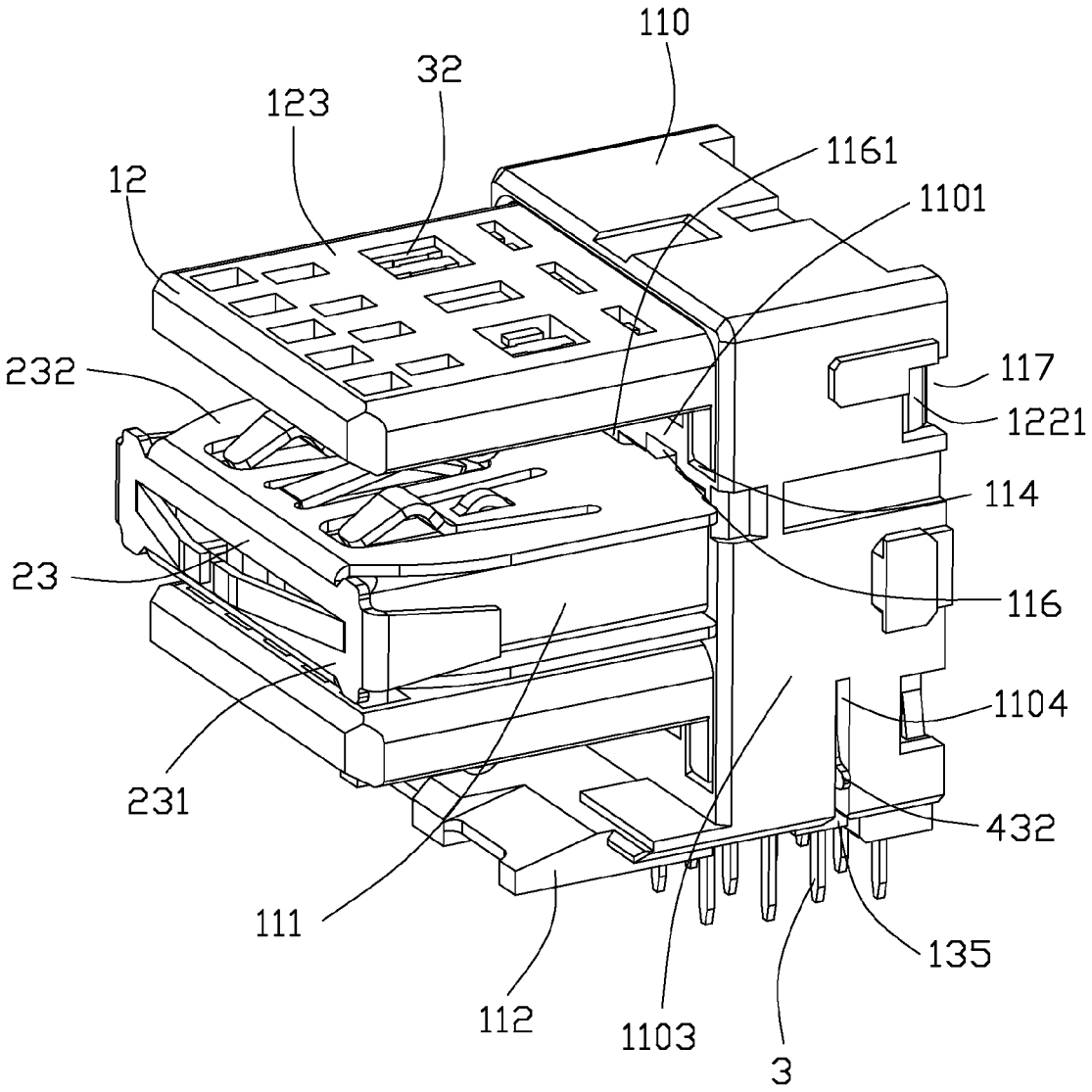
FIG. 2 is a view of the electrical connector with its front shell removed.
Figure 3:
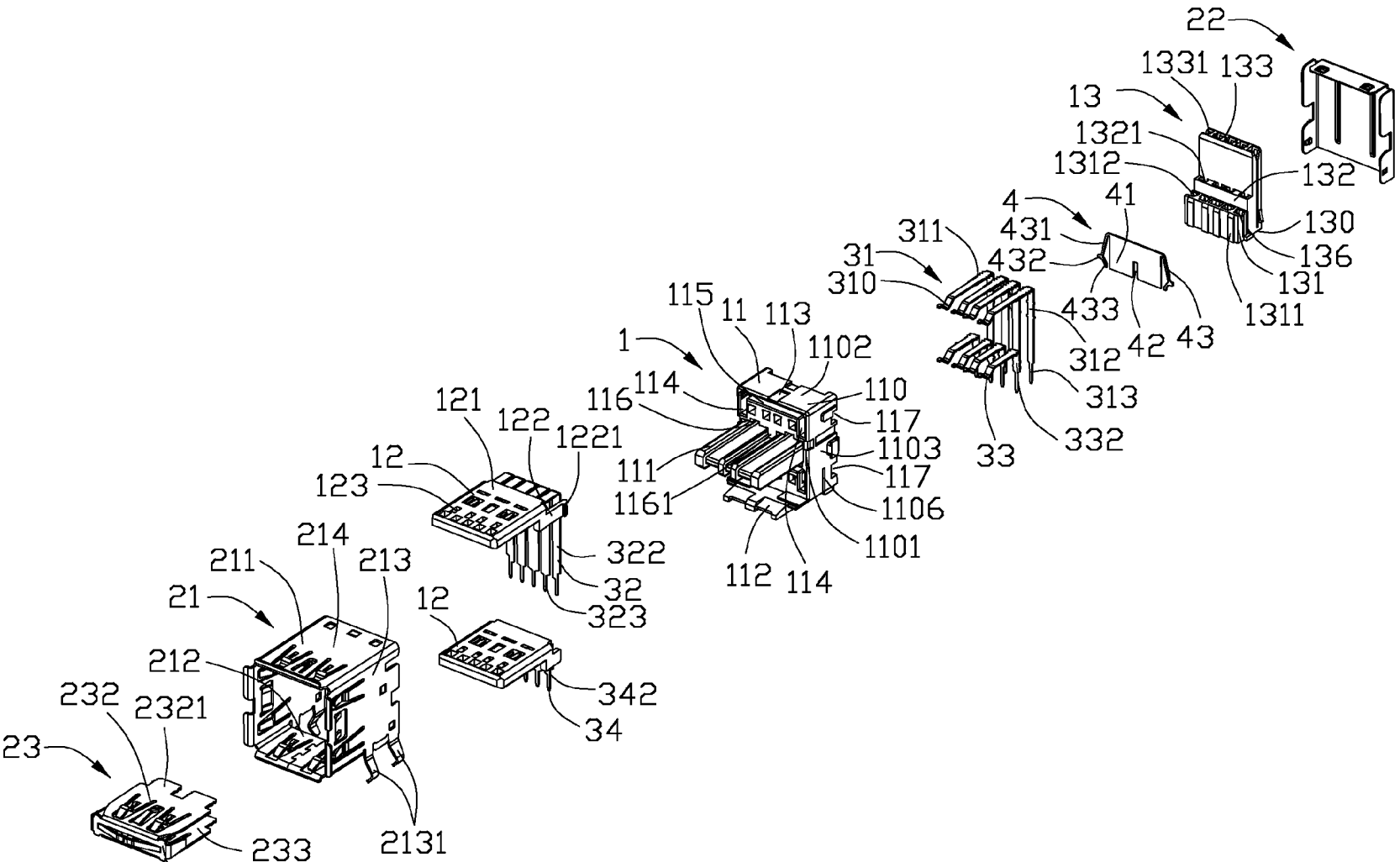
FIG. 3 is an exploded perspective view of the electrical connector.

Referring to FIGS. 1-3, an electrical connector 100 according to a first embodiment of the present invention is disclosed. The electrical connector 100 is a stacked receptacle with two single receptacles, one located on the top and the other on the below. Now, detailed description of the extension to the electrical connector 100 is made below. The electrical connector 100 includes an insulative housing 1, a plurality of contacts 3 received in the insulative housing 1, a metal shell 2 enclosing the insulative housing 1 and a metal plate 4 attached in the insulative housing connecting with metal shell 2.

Please referring to FIGS. 3-6, the insulative housing 1 includes a main body 11, a top and a bottom tongue portions 12 assembled to the main body 11 in a front-to-rear direction and a spacer 13 assembled in a rear side of the main body 11 along a down-to-up direction. The main body 11 includes a base portion 110, a separating plate 111 and a supporting plate 112 both extending forwardly from a front side of the base portion 110. The separating plate 111 and the supporting plate 112 are integrally injecting molded as one piece of the base portion 110. The separating plate 111 is positioned between the pair of tongue portions 12. The supporting plate 112 is extending forwardly from a front side of a bottom of the base portion 110 and parallel to the separating plate 111. The base portion 110 defines a front face 1101, a top face 1102, two side faces 1103, a rear face 1104 and a rear room 1105 depressed forwardly on the rear face along a rear-to-front direction to receive the spacer 13. The base portion 110 is divided into two parts via the separating plate 111, now taking the top one for example. In the top one, the base portion 110 includes a first retaining slot 113 depressed on the front face 1101, two second retaining slots 114 extending downwardly from two sides of the first retaining slot 113 and a plurality of through holes 115 extending through the base portion 110 along the front-to-rear direction. The through holes 115 are formed between the two second retaining slots 114 and located under the first retaining slot 113. The base portion 110 further includes two notches 117 extending through the side face 1103 and the rear face 1104, two stretching slots 1106 extending through the two side faces 1103 respectively, and two locking slots 116 depressed on the front face 1101 near to a top and bottom sides of the separating plate 111. Two separating posts 1161 are defined in each locking slot 116 to divide the locking slot 116 into two parts.

In this embodiment, the tongue portions 12 are assembled to the base portion 110. In other embodiments, the tongue portions 12 can be integrally injecting molded as one piece of the base portion 110. Each of the tongue portion 12 includes a first retaining portion 121 retained in the first retaining slot 113, two second retaining portions 122 extending downwardly from two sides of the first retaining portion 121 retained in two second retaining slots 114, respectively, and a main body 123 extending forwardly from the first retaining portion 121. The second retaining portion 122 defines a pair of locking portions 1221 protruding outside of two sides of the second retaining portion 122 received in two notches 117 of the two side faces 1103. The main body 123 defines a bottom face with a plurality of first contact receiving passageways 124 and a plurality of second contact receiving passageways 125 recessed therein. The first contact receiving passageways 124 all extend from the tongue portion 12 towards the base portion 110. The second contact receiving passageways 125 locate after the first contact receiving passageways 124.

The spacer 13 is received in the rear room 1105 of the base portion 110 and has a base 130. The spacer 13 is step shaped and includes a lower portion 131, an rear portion and a groove 136 located therebetween. The rear portion includes a middle portion 132 and a higher portion 133 which are all extending upwardly from the base 130. The groove 136 is located behind the lower portion 131 and located in front of the middle portion 132 and the higher portion 133. The groove 136 extends through the spacer 13 along a transverse direction but not extends through the spacer 13 along the up-to-down direction. Please reference to FIG. 6, a positioning post 134 protrudes into the groove 136 at a middle of the groove 136. Two protruding block 135 protrude outside of the two sides of the base 130 and locate at two ends of the groove 136 along the transverse direction. The lower portion 131 has a front surface with a plurality of ribs 1311 protruding thereof and a plurality of first through holes 1312 extending through the lower portion 131 along the up-to-down direction. The middle portion 132 also includes a plurality of second through holes 1321 extending through the middle portion 132. The higher portion 133 includes a plurality of third through holes 1331 extending through the higher portion 133.

Figure 4:
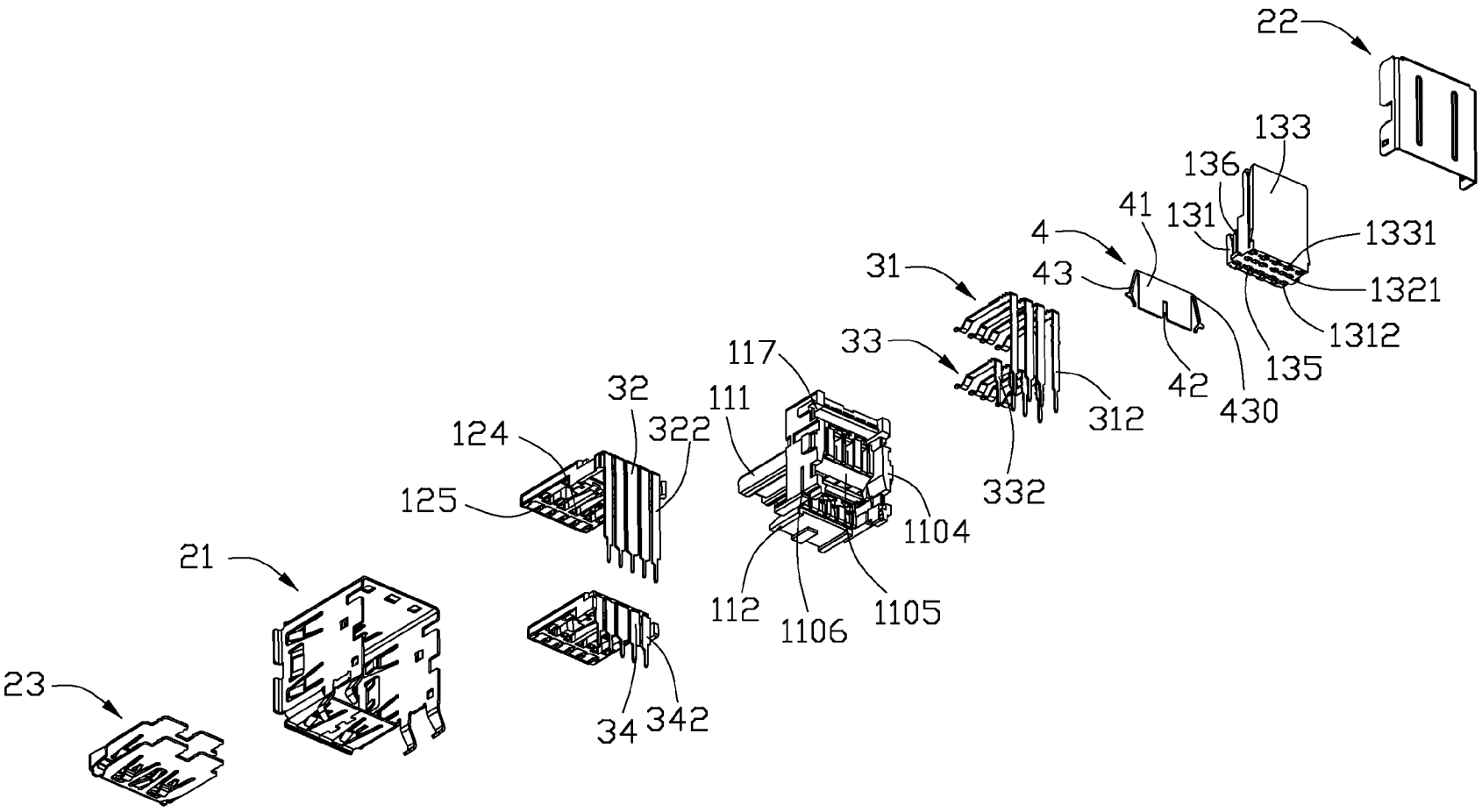
FIG. 4 is another exploded perspective view of the electrical connector, while taken from a different aspect.

As shown in FIGS. 3-4, an arrangement of the contacts 3 in the two single receptacles are same, so now taking the top receptacle port for example. In the top receptacle, we called the contacts 3 as upper contact, the upper contact include four conductive contacts 31 and a plurality of additional contacts 32. Each of the conductive contacts 31 has a contact portion 310 disclosed on a bottom side of the top tongue 12, a retaining portion 311 extending backwardly from the contact portion 310, an extending portion 312 bending downwardly from a rear end of the retaining portion 311 and a first tail portion 313 extending vertically from a bottom end of the first extending portion 312. The contact portions 310 are cantilevered accommodated in the first contact receiving passageways 124 and protrude downwardly beyond the bottom face so that the contact portion 310 is elastic and deformable when engaging with a plurality of plug conductive contacts. The retaining portions 311 positioned in the through holes 115 extend through the through holes 115 and partly extend into the first contact receiving passageways 124. The first extending portions 312 are received in the second through slots 1321 of middle portion 132 of the spacer 13. Each of the additional contacts 32 has a flat and non-elastic contact portion 321 supported by the bottom face of the tongue portion 12 and disclosed in the second contact receiving passageways 125, an engaging portion (not labeled) most partly inserted-mold in the tongue portion 12, a second extending portion 322 extending downwardly from a rear end of the engaging portion and a second tail portion 323 extending vertical from a bottom of the second extending portion 322. The second extending portions 322 are received in the third through holes 1331 of the higher portion 133 of the spacer 13 and the second tail portions 323 extend beyond a bottom of the spacer 13. The bottom receptacle include a same arrangement of the contacts 3 that retained in the top receptacle wherein the contacts 3 retained in the bottom receptacle are both much shorter than that in the top receptacle. We called the contacts 3 arranged in the bottom receptacle as lower contact, the lower contact also include four conductive contacts 33 and a plurality of additional contacts 34. Each of the conductive contacts 33 has a third contact portions disclosed on a bottom side of the lower tongue portion, a third extending portion 332 extending along the up-to-down direction, the third extending portions 332 are sandwiched between an inner wall of the rear room 1105 and the ribs 1311 of the lower portion 131 of the spacer 13. Each of the additional contact 34 has a four extending portion 342 extending through the first through holes 1312 vertically.

Figure 5:
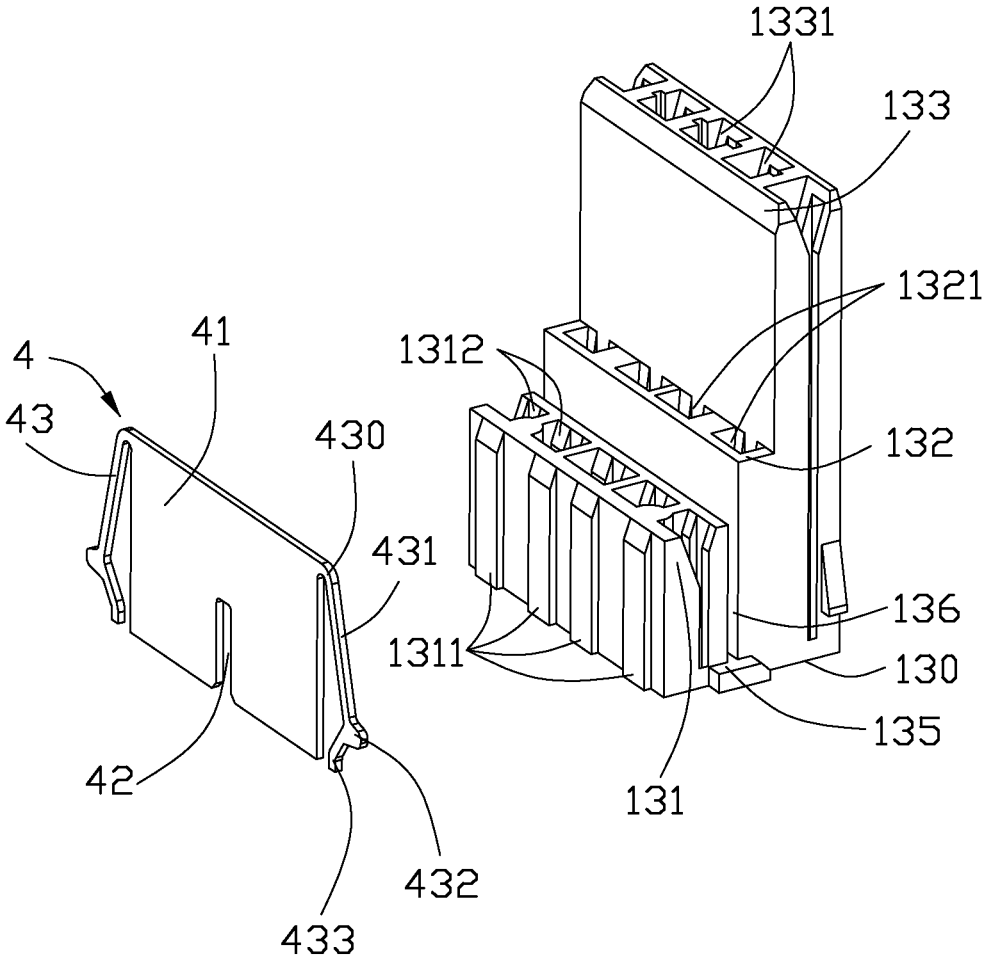
FIG. 5 is a view of a spacer and a metal plate separating from each other of the electrical connector.
Figure 6:
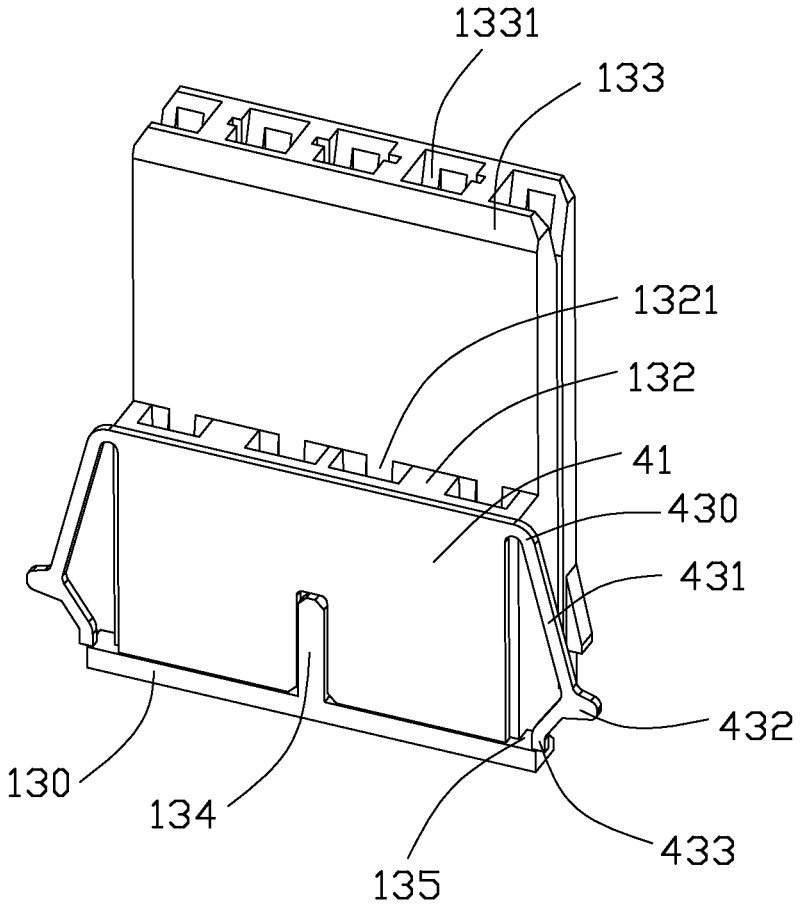
FIG. 6 is a cross-sectional view of the metal plate assembled to the spacer of electrical connector.
Figure 7:
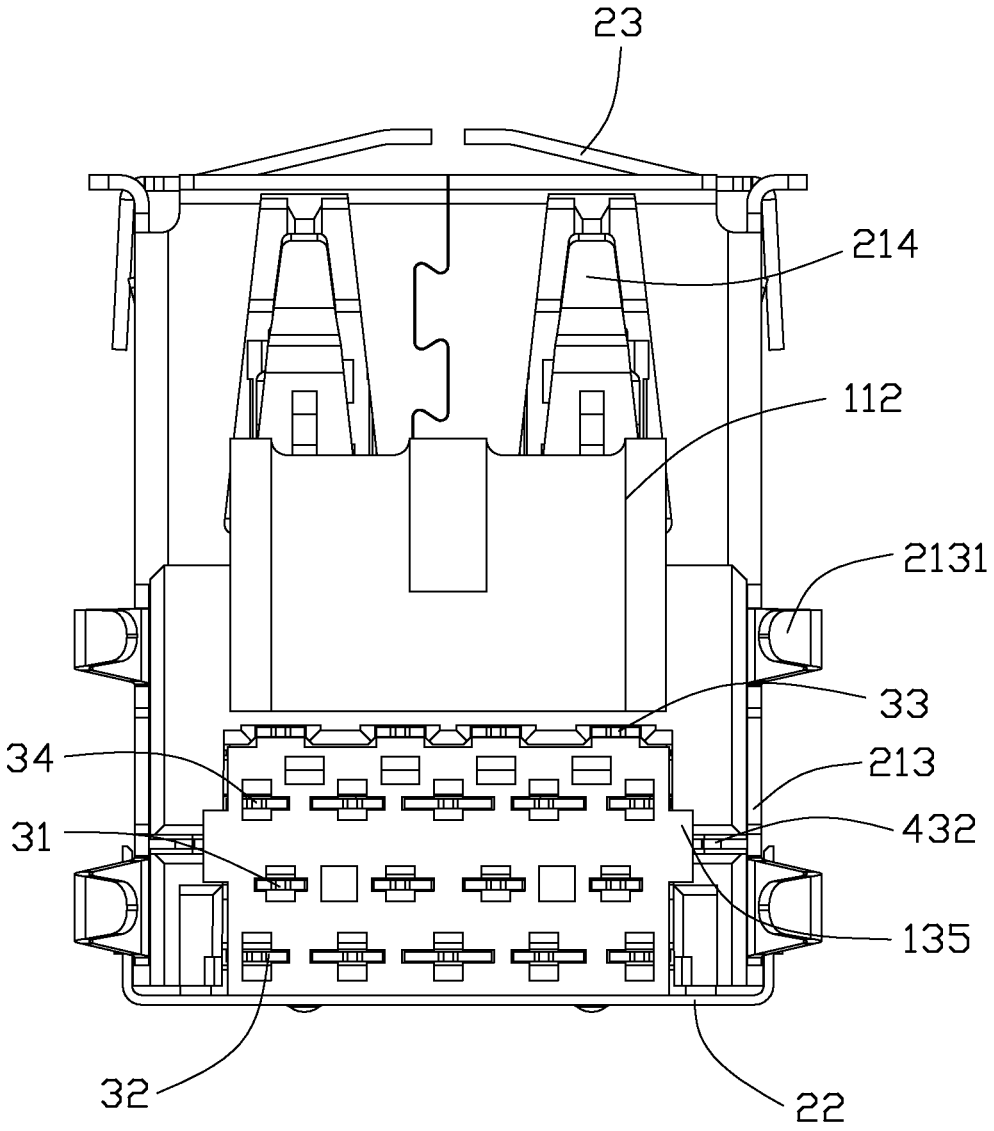
FIG. 7 is a bottom plan view of the electrical connector.

As shown in FIGS. 5-7, The metal plate 4 has a main portion 41, a notch 42 depressed on a bottom side of the main portion 41 for locking with the positioning post 134 of the spacer 13 and two cantilever arms 43 extending outside of two side edges of a top edge of the main portion 41. The main portion 41 and the two cantilever arms 43 are coplanar with each other. The main portion 41 assembled to the groove 136 along the up-to-down direction. The cantilever arm 43 has a bent portion 430 connecting with one side end of the top edge of the main portion 41, an extending portion 431 extending slant from a free end of the bent portion 430 and extending beyond the groove 136 along a transverse direction, a protruding portion 432 protruding outside from a free end of the extending portion 431, and a supporting portion 433 connecting with the protruding portion 432 and extending inwardly to the main portion 41 to make the cantilever arm 43 form a “>” shape. The supporting portion 433 is supported by the protruding block 135 along the up-to-down direction. Along the up-to-down direction, a length of the cantilever arm 43 is almost same as a length of the main portion 41.

The metal shell 2 has a front shield shell 21, a rear shield shell 22 locking with the front shield shell 21 to form a receiving chamber for receiving the insulative housing 11, and an inner shield shell 23 covering the separating plate 111. The front shield shell 21 has a top wall 211, bottom wall 212 opposite to the top wall 211, and two side walls 213 connecting with the top wall 211 and the bottom wall 212. The top, bottom and side walls all form a plurality of spring taps 214 therein. Each of the side walls 213 has a pair of soldering legs 2131 extending downwardly from a bottom side thereof to solder in a PCB board (not shown). The inner shield shell 23 has a front wall 231, a pair of horizontal walls 232 extending backwardly from an up and down edges of the front wall 231 respectively, a receiving cavity 233 formed between the pair of horizontal walls 232 for receiving the separating plate 111. The horizontal wall 232 has two bulges 2321 extending along a front-to-rear direction into the two locking slots 116 of the base portion 110 to make the inner shield shell 23 positioned in the insulative housing 1.

please referring to FIGS. 4-7, as the metal plate 4 is set between the upper contacts and lower contacts and two cantilever arms 43 abutted against with the metal shell 2, in such arrangement, the metal plate 4 can provide a profit of grounding and avoid crosstalk between the upper and lower contacts 3. At the same time, the cantilever arms 43 can provide an improved elastic force to make the metal plate 4 connect with the metal shell 2 steady along the transverse direction.

Figure 8:
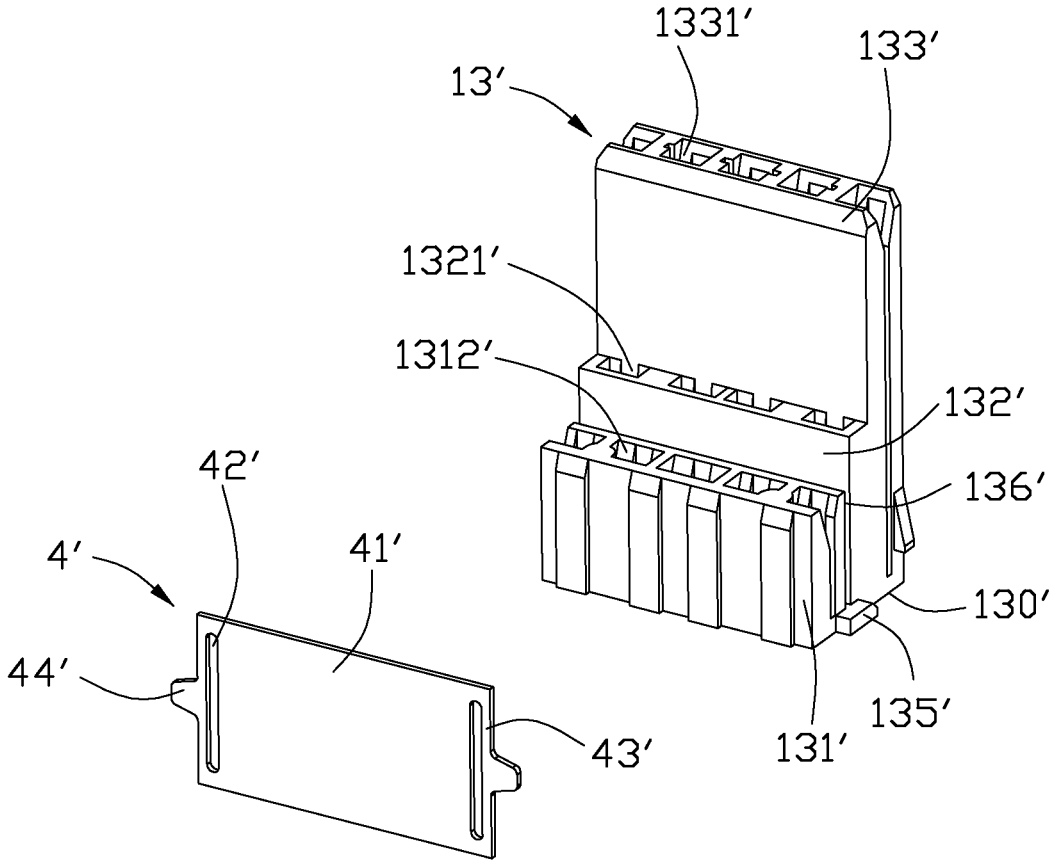
FIG. 8 is a view of a spacer and a metal plate separating from each other of a second embodiment of the electrical connector.

Referring to FIG. 8, an electrical connector according to a second embodiment of the present invention is disclosed. Structures of the electrical connectors in the second embodiment is similar to the electrical connector of the first embodiments, and a small difference is that: the metal plate 4' has a main portion 41' retained in the spacer 13' vertically, two slits 42' extending through two sides of the main portion 41' respectively along a front-to-rear direction to form two bridge beams 43', each of the bridge beams 43' forms a protruding portion 44' protruding outside of the insulative housing to engage with the side wall 213' of the metal shell 2'. The slits 42' extend along the up-to-down direction and parallel to each other. The slit 42' provide a deformation space for the bridge beam 43' along the transverse direction while the protruding portion 44' abutting against with the side wall 213'. The protruding portions 44', the bridge beams 43' and the main portion 41' all extend in a flat surface. As the metal plate 4 is set between the upper contacts and lower contacts, in such arrangement, the metal plate 4 can provide a profit of grounding and avoid crosstalk between the upper and lower contacts 3. At the same times, the slit 42 can provide a deformation space for the bridge beam 43 along the transverse direction which can give the bridge beam 43 an improved elastic force to make the metal plate 4 connect with the metal shell 2 steady. So, the electrical connector of the second embodiment can achieve the purpose of the present invention also.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing having a base portion with a rear room depressed thereof along an rear-to-front direction, a top and a lower tongue portions extending forwardly from the base portion;

a plurality of contacts retained to the insulative housing, the contacts having a plurality of upper contacts with a plurality of contact portions disclosed on a bottom side of the top tongue portion and a plurality of lower contacts with a plurality of contact portions disclosed on a bottom side of the lower tongue portion;

a spacer received in the rear room;

a metal plate having a main portion retained in the spacer vertically and at least a cantilever arm extending outside from a side end of the main portion, the cantilever arm and the main portion being coplanar with each other in a same vertical plane, said cantilever arm being deflected in said vertical plane; and a metal shell having two side walls covering two sides of the insulative housing;

wherein the cantilever arm extends outside of the spacer and having a protruding portion protruding beyond a side of the insulative housing to abut against the side wall of the metal shell.

2. The electrical connector as claimed in claim 1, wherein the cantilever arm further has a bent portion connecting with one side end of a top edge of the main portion, a extending portion extending slant from a free end of the bent portion and slanting outside of the main portion, the protruding portion protruding outside from a free end of the extending portion, and a supporting portion extending inwardly to make the cantilever arm form a > shape.

3. The electrical connector as claimed in claim 2, wherein the spacer has a base, a groove depressed therein along an up-to-down direction and a pair of protruding blocks extending beyond the two sides of the base respectively and aligned with the groove along a transverse direction, the supporting portion supported by the protruding block.

4. The electrical connector as claimed in claim 3, wherein a length of the cantilever arm is almost same as a length of the main portion along the up-to-down direction.

5. The electrical connector as claimed in claim 3, wherein the spacer is step shaped and includes a lower portion located at front of the groove, a rear portion located behind the groove, the base further comprises a positioning post protrudes upwardly into the groove, the main portion positioned on the groove via a notch depressed on a bottom side of the main portion locked with the positioning post.

6. The electrical connector as claimed in claim 5, wherein the support portion is supported by the protruding block along the up-to-down direction while the protruding portion abutting against with the side wall along the transverse direction.

7. The electrical connector as claimed in claim 5, wherein the lower portion of the spacer has a plurality of through holes extending through the base along the up-to-down direction, the rear portion of the spacer having a middle portion and a higher portion also defining a plurality of through holes extending therethrough.

8. The electrical connector as claimed in claim 6, wherein the upper contacts further have a plurality of extending portions extending through the through holes of the rear portion, the lower contacts further having another plurality of extending portions extending through the through holes of the lower portion of the spacer respectively, the main portion located between the upper contacts and the lower contacts.

9. The electrical connector as claimed in claim 2, wherein the base portion of the insulactive housing has a front face, a rear face and two side face connecting with the front face and the rear face, the rear room is recessed on the rear face, the base portion further defines a stretching slot extending vertically and extending through the side face to let the protruding portion protruding beyond the side face of the base portion.

10. The electrical connector as claimed in claim 9, wherein the spacer with the metal plate attached in its groove is assembled to the insulative housing and received in the rear room, the bent portion and the extending portion are located inside of the side face of the base portion while the protruding portion is located outside of the side face of the base portion.

11. An electrical connector comprising:

an insulative housing having a base portion with a rear room depressed thereof along an rear-to-front direction, a top and a lower tongue portions extending forwardly from the base portion;

a plurality of contacts retained to the insulative housing, the contacts having a plurality of upper contacts with a plurality of contact portions disclosed on a bottom side of the top tongue portion and a plurality of lower contacts with a plurality of contact portions disclosed on a bottom side of the lower tongue portion;

a spacer received in the rear room; and a metal shell having two side walls covering two sides of the insulative housing;

wherein a metal plate has a main portion retained in the spacer vertically, a slit extending through a side of the main portion along a front-to-rear direction to form a bridge beam, the bridge beam forms a protruding portion protruding outside of the insulative housing to engage with the side wall of the metal shell.

12. The electrical connector as claimed in claim 11, wherein the metal plate has two said slits extending along an up-to-down direction and the two slits parallel to each other, the protruding portion, the bridge beam and the main portion all extend in a flat surface.

13. The electrical connector as claimed in claim 12, wherein the spacer has a base, a groove depressed therein along an up-to-down direction and a pair of protruding blocks extending beyond the two sides of the base respectively and aligned with the groove along a transverse direction, the main portion received in the groove while the protruding portion protruded outside of the groove.

14. The electrical connector as claimed in claim 13, wherein the base portion has two side walls located outside of the rear room, a stretching slot extends through the one of the side walls to let the protruding portion protruding outside of the insulative housing.

15. The electrical connector as claimed in claim 14, wherein the slit provides a deformation space for the bridge beam along the transverse direction while the protruding portion abutting against with the side wall.

16. An electrical connector comprising:

an insulative housing defining opposite upper and lower front mating ports in a vertical direction, and a rear mounting port opposite to said front mating ports in a front-to-back direction perpendicular to said vertical direction;

a plurality of upper and lower contacts disposed in the housing with front mating sections exposed in the mating ports and rear mounting sections exposed in the mounting port;

an insulative spacer attached to a rear side of the housing in the mounting ports, said spacer forming a front group of through holes through which the mounting sections of the lower contacts extend, and a rear group of through holes through which the mounting sections of the upper contacts extend;

a metallic shell enclosing both the housing and the spacer; and a metallic plate extending in a vertical plane perpendicular to said front-to-back direction, and associated with the spacer to be located between the front group of through holes and the rear group of through holes in the front-to-back direction; wherein the metallic plate and the metallic shell mechanically and electrically connect to each other in a transverse direction coplanar with said vertical plane; wherein said metallic plate forms a resilient extending portion and a protruding portion unitarily formed around an outermost end of the extending portion to contact the metallic shell, and said extending portion is deflected in said vertical plane.

17. The electrical connector as claimed in claim 16, wherein said transverse direction is perpendicular to both said vertical direction and said front-to-back direction.

18. The electrical connector as claimed in claim 16, wherein a side face of the housing forms a stretching slot extending along the vertical direction, in which the protruding portion is received and further extends out of said side face in said transverse direction to contact the metallic shell.

19. The electrical connector as claimed in claim 18, wherein said side face extends rearward to reach a rear portion of the spacer to substantially fully protecting and covering said spacer in the transverse direction around a corner of the rear side and a bottom face of the housing.

20. The electrical connector as claimed in claim 11, wherein a side face of the base portion beside the rear room forms a stretching slot extending along an up-to-down direction perpendicular to said rear-to-front direction, and the protruding portion is received within said stretching slot.

* * * * *